US007604506B2

(12) United States Patent
Gucwa

(10) Patent No.: US 7,604,506 B2
(45) Date of Patent: Oct. 20, 2009

(54) LAMP SOCKET ASSEMBLIES WITH AXIAL TERMINALS

(75) Inventor: Mark D. Gucwa, Mayville, MI (US)

(73) Assignee: Empire Electronics, Inc., Troy, MI (US)

( * ) Notice: Subject to any disclaimer, the term of this patent is extended or adjusted under 35 U.S.C. 154(b) by 27 days.

(21) Appl. No.: 11/617,870

(22) Filed: Dec. 29, 2006

(65) Prior Publication Data

US 2008/0160821 A1 Jul. 3, 2008

(51) Int. Cl.
*H01R 33/09* (2006.01)

(52) U.S. Cl. ..... 439/619; 439/699.2; 439/300

(58) Field of Classification Search ..... 439/619, 439/699.2, 300

See application file for complete search history.

(56) References Cited

U.S. PATENT DOCUMENTS 6,250,970 B1 * 6/2001 Key et al. ..... 439/699.2
6,692,309 B1 * 2/2004 Kovacs ..... 439/699.2
7,153,171 B1 * 12/2006 Goto ..... 439/699.2

* cited by examiner

*Primary Examiner*—Truc T Nguyen
(74) *Attorney, Agent, or Firm*—Gifford, Krass, Sprinkle, Anderson & Citkowski, P.C.

(57) ABSTRACT

Wedge bulb lamp socket assemblies with potted axial terminal members. The terminals are held in place by tab members in the blades until the potting material is added. Ramp members are provided in the socket bodies in order to facilitate insertion of the lamp bulbs in the sockets, and shroud members are provided to protect the ends of the terminal members from being damaged during insertion of the lamp bulbs.

10 Claims, 6 Drawing Sheets

LAMP SOCKET ASSEMBLIES WITH AXIAL TERMINALS

TECHNICAL FIELD

The present invention relates generally to wedge-type bulb lamp socket assemblies and more particularly to lamp socket assemblies having potted axial terminals.

BACKGROUND OF THE INVENTION

Structural requirements for lamp socket assemblies are vary widely depending on the applications in which the lamp and the socket are to be used. Some of the most demanding applications are those in which the lamp and socket may be exposed to variable and occasionally harsh environmental conditions. Such conditions can expose portions of the lamp and/or socket vulnerable to those environmental conditions, potentially effecting functioning of the lamp and socket. For example, exposure to the water in the form of rain or high humidity can cause corrosion and shorting, leading to failure of the lamp bulb. One way to minimize the risk of failure is to prevent exposure of vulnerable portions of the lamp and/or socket assembly to the effects of harsh environments. In particular, the connection of a lamp to a power supply must be maintained in order to prevent failure of lamp function. Typically, such a connection is protected by embedding the connection in a material which seals the connection against water or other detrimental conditions. For example, a sealing material may be used to protect these sensitive components from impact, shock, vibration, moisture and chemicals.

In spite of the effectiveness of sealing approaches, they are limited by certain socket design constraints. In many applications for a lamp socket, space considerations are important. Also, the ability to easily install or assemble the lamp socket assemblies, as well as the lighting harness member in a particular lighting component, for example, for a vehicle, is also a design constraint and consideration.

Moreover, manufacturing and assembly processes require that the components of the lamp socket be assembled in the quickest and most efficient manner. At the same time, however, the terminals must be seated properly and all electrical connections be satisfactory for ultimate use of the product. Thus, the ability to assemble the components in the fastest and easiest manner with the least complications is a goal of the manufacturing and assembly processes.

One of the requirements of lamp socket assemblies in accordance with the present invention is that a significant plurality of the lamp socket assemblies be produced in the quickest and easiest manner with the least cost, and yet have the highest quality and degree of performance.

Thus, there is a continuing need for lamp socket assemblies which allow for improved efficiency in the manufacturing and assembly and at the same time provide for superior performance under all conditions, particularly harsh environmental conditions.

SUMMARY OF THE INVENTION

A potted lamp socket assembly is provided according to the present invention that provides improved manufacturing processing and at the same time provides improved performance for its assembly and use. The major and minor electrical terminals, as well as the ground terminal, are preferably all axial terminals, that is, the terminal blade members and lead support portions are in axial alignment with one another.

Also, a metal spring clip member is used to maintain the wedge-type lamp bulbs in place in the lamp socket blades. Ramp members in the insertion channel for the lamp bulb prevent hang ups and complications during insertion and facilitate assembly. Shroud members adjacent the electrical terminals protect the terminals when the lamp bulb is being inserted in the socket. The spring clip and electrical terminals have locking tabs on them in order to securely hold them in place until the potting material is added to the lamp socket. The potting material seals the assembly and retains the terminals and spring clip permanently in position.

The configuration of the lamp socket is optimized to insure minimum wobble of the lamp bulb and also provide terminal protection during bulb insertion and assembly. A plurality of wire dress slots are provided for the lamp socket and associated components. The wire slots are radiused on their edges to prevent wire lead damage. Identification indicia on the lamp socket, such as the focal length, are provided on the opposite side of the wire slots so that the wires do not block the identification indicia.

The potting material fills the cavity in which the wire leads are positioned and fully encapsulates the contact area, as well as seals the leads and supports.

Other objects and features of the present invention will become apparent when viewed in light of the detailed description and preferred embodiments when taken in conjunction with the attached drawings and appended claims.

DESCRIPTION OF THE PREFERRED EMBODIMENTS

Figure 1:
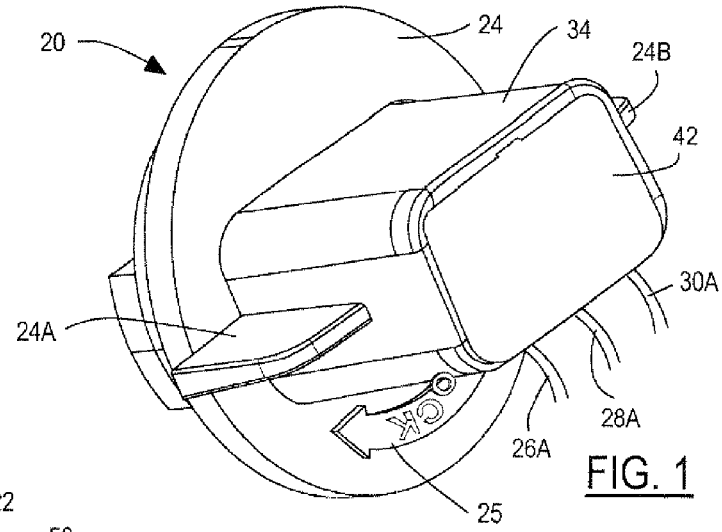
FIG. 1 is a perspective view of a lamp socket assembly in accordance with the present invention.
Figure 2:
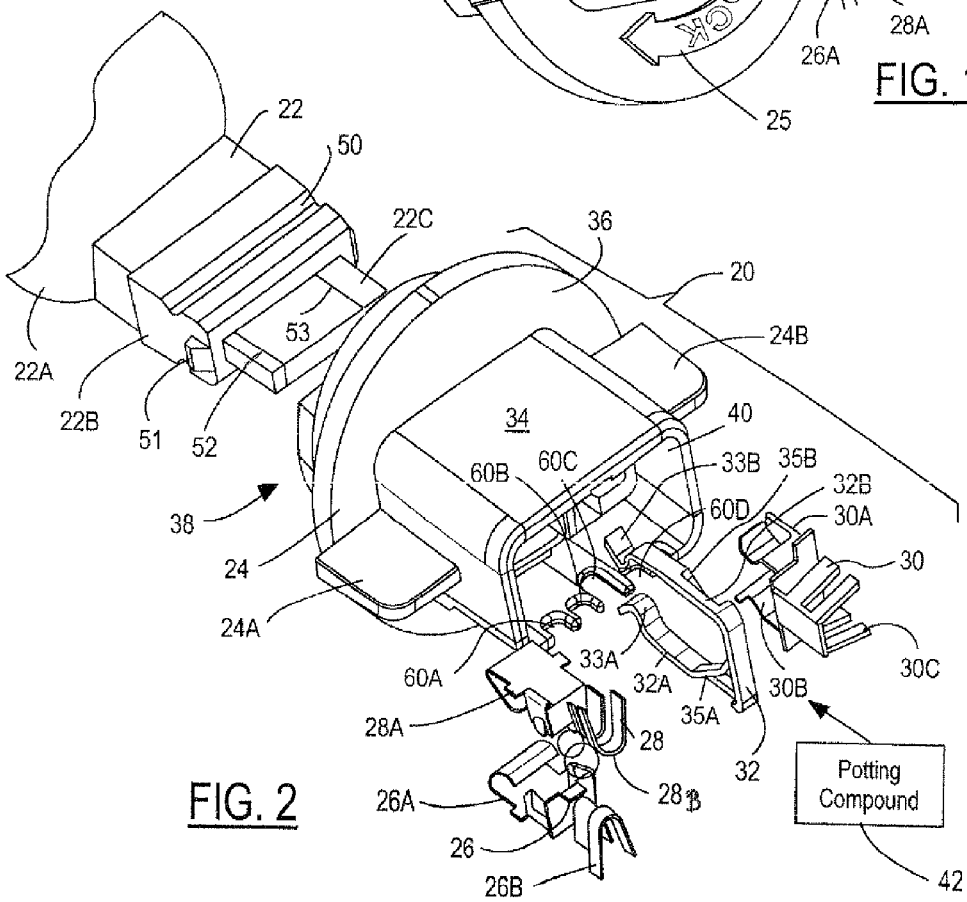
FIG. 2 is an exploded view of a lamp socket assembly in accordance with the present invention.

A lamp socket assembly in accordance with the present invention is shown in FIG. 1 and indicated generally by the reference numeral 20. FIG. 2 is an exploded view of the lamp socket assembly in accordance with the present invention, together with a wedge-type lamp bulb (a/k/a light bulb) 22.

The lamp socket assembly includes a lamp socket body member 24, a major electrical terminal member 26, a minor electrical terminal member 28, a ground electrical terminal member 30, and a metal spring clip member 32. The lamp socket body member 24 includes a wire or lead receiving end portion 34 at one end, a central flange member 36, and a lamp bulb insertion end portion 38.

The lead receiving end portion 34 has a cavity 40 in which the wire leads are positioned when the lamp socket assembly is assembled, as shown in FIG. 1. Wire lead members 26A, 28A, and 30A are secured to the respective terminals 26, 28 and 30 and positioned in the cavity 40 of the lead receiving end portion 34.

Figure 6:
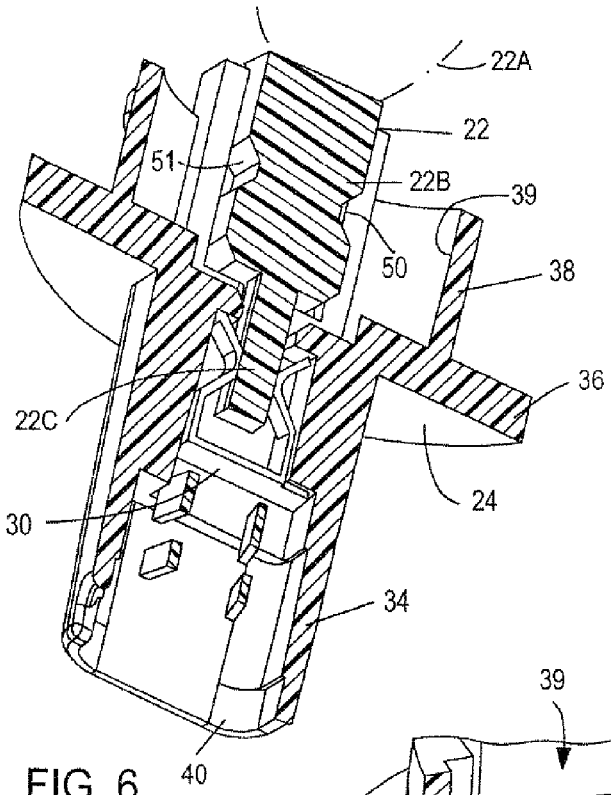
FIGS. 6, 7, and 8 are additional cross-sections of a lamp socket body member in accordance with the present invention, the cross-sections showing various features of the present invention.

The bulb insertion portion 38 of the lamp socket body 24 has a cavity 39 in which the lamp bulb 22 is positioned. This is shown in particular in FIG. 6.

A potting compound, which can be a epoxy potting composite or any of the conventional potting compositions and materials in use today for lamp sockets, is then added in the cavity 40 in order to encapsulate the ends of the wire leads 26A, 28A and 30A, together with the ends of the terminals 26, 28, and 30. The potting compound is generally referred to by the reference numeral 42 in FIGS. 1 and 2. In this regard, the other Figures, namely FIGS. 3-11, do not show the use of the potting compound, but instead concentrate on details of the lamp socket body member 24. It is understood, however, that when the lamp socket body member 24 is assembled in final form to become the lamp socket assembly 20, potting compound 42 is added in order to encapsulate the ends of the wire leads.

As shown in the drawings, particularly FIG. 2, each of the electrical terminal members 26, 28, and 30 are preferably all axial terminals. With axial terminals, the blade members and the wire lead support portions are in axial alignment, that is at 180° relative to each other. It is understood, of course, that other shapes and styles of electrical terminal members could be provided, such as right-angle terminal members.

The bulb member 22 can be any of the standard lamp bulbs in common use today in lamp socket assemblies, such as the S-8 lamp bulbs. The lamp bulbs have a glass bulb member 22A which houses the filaments which illuminate and create light. The lamp bulb members 22 also have a base member 22B which is inserted into the bulb insertion end portion 38 of the lamp socket body 24. As shown in FIG. 2 (and FIG. 6), the base member 22B on the lamp bulb 22 has a pair of groove members 50 and 51 on opposite sides of the base member which mate with the ends of the spring clip members 32 in order to hold the lamp bulb securely in place in the lamp socket body member 34. The base member 22B also has a projecting member 22C at the distal end which has a pair of wire contacts 52 and 53 thereon which supply the necessary electricity and energy to the lamp bulb in order to light the filament and create illumination from the light bulb.

The lamp socket body 24 also has a pair of flange or wing members 24A and 24B which are used to manually insert and rotate the lamp socket assembly 20 in an appropriate lighting fixture. The arrow designation 25 on the lamp socket flange member 36 indicates the direction in which the socket assembly is to be rotated in order to lock it in place in a lighting component or fixture. In this regard, the lighting component is typically a tail lamp assembly or head lamp assembly for a vehicle, such as an automobile.

Figure 11:
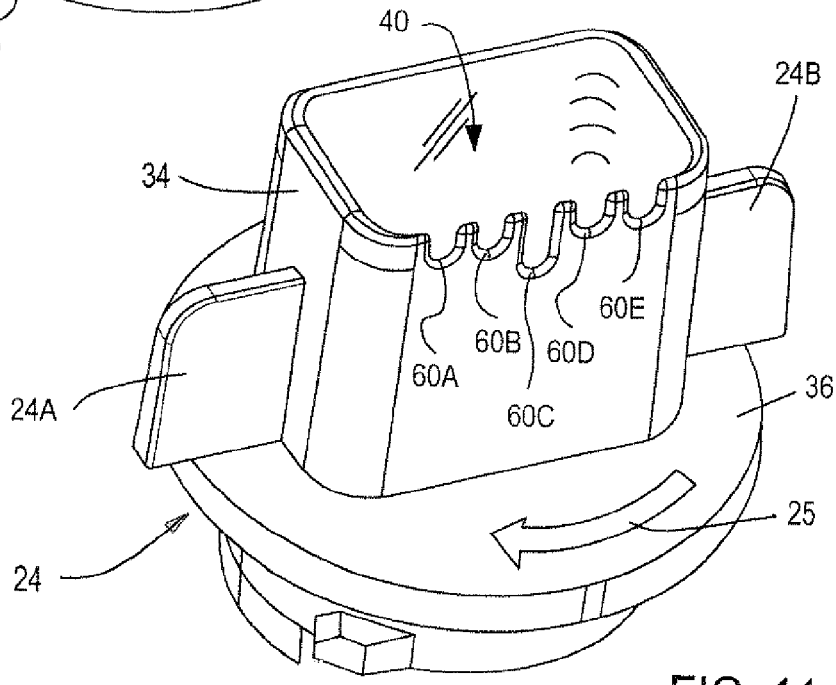
FIG. 11 is a perspective view of a lamp socket body member in accordance with the present invention particularly showing the wire dress slots.

The lead receiving end 34 of the lamp socket body 24 has a plurality of wire slots 60A-60E. The slots are also shown in FIG. 11. In a preferred embodiment, five wire slots are provided which have the capacity for a total of six wire leads. In this regard, one of the wire slots 60C is larger than the others and has capacity for two wires. Also, as shown in FIGS. 2 and 11, the wire slots were all radiused on the edges to prevent damage to the wire leads.

The spring clip member 32 is preferably made from a metal material to provide the relative durability and holding capacity in order to securely hold the lamp bulb 22 in place in the lamp socket body 24. As shown in FIGS. 2, 3, 5 and 7, in particular, the spring clip members 32 have a generally U-shaped body with a pair of fingers or arm members 32A and 32B. The arm members in turn have spring-type end members 33A and 33B which are used to mate with the groove slot members 50 and 51 in the lamp bulb 22 in order to hold the lamp bulb in place in the lamp socket body 24.

The spring clip members 32 also have a pair of tab members 35A and 35B which are used to hold and retain the spring clip members 32 in place in the lamp socket body 24 until the potting compound 42 is added which permanently holds the spring clip member in position. The arm members 32A and 32B are inserted through openings and into channels in the lamp socket body 24 and the spring-type tab members 35A and 35B are forced against the sides of the channels preventing unintended displacement or removal of the spring clip members 32.

Figure 10:
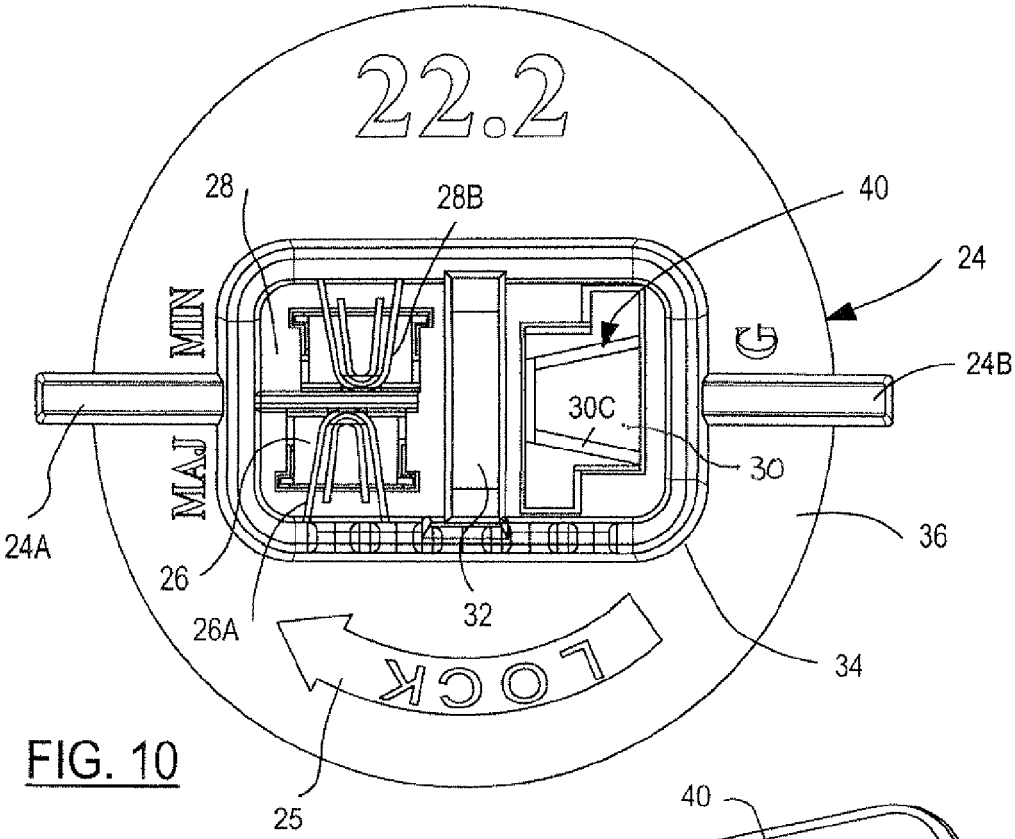
FIG. 10 is an elevational view of the present invention showing the wire lead end of the lamp socket body member prior to addition of wire members and potting material.

Identification indicia, such as focal length "22.2" as shown in FIG. 10, can be imprinted on or molded into the lamp socket body member 24. This allows easy selection (and prevents misselection) of the appropriate lamp socket assembly to use in the particular application. Also as indicated in FIG. 10, the indicia, such as the focal length, is positioned on the flange member on the opposite side of the wire slots 60A-60E so that the indicia will be easily readable even when the wire leads, such as 26A, 28A, and 30A, are installed in the lamp socket body.

As indicated, all of the electrical terminals, namely the major and minor terminal members 26 and 28, and the ground terminal member 30 are preferably axial terminals with the blade members and wire lead support portions in alignment. As shown in particular in FIG. 2, the minor electrical terminal includes a blade member 26A and a wire support portion 26B, the major electrical terminal 28 includes a blade member 28A and a wire lead support portion 28B, and the ground terminal 30 is a box-type member and includes a pair of blade members 30A and 30B as well as a wire lead support portion 30C.

The three electrical terminal members are inserted into the lamp socket body 24 through the wire lead connection portion 34. The terminal members are inserted through openings and channels provided in the interior of the lamp socket body 24. The blade members 26A and 28A mate on opposite sides with the wire contact 52 on the lamp bulb base member 22B, while the blades of the ground terminal 30 mate with the wire contact 53 on the lamp bulb base member 22B.

Figure 7:
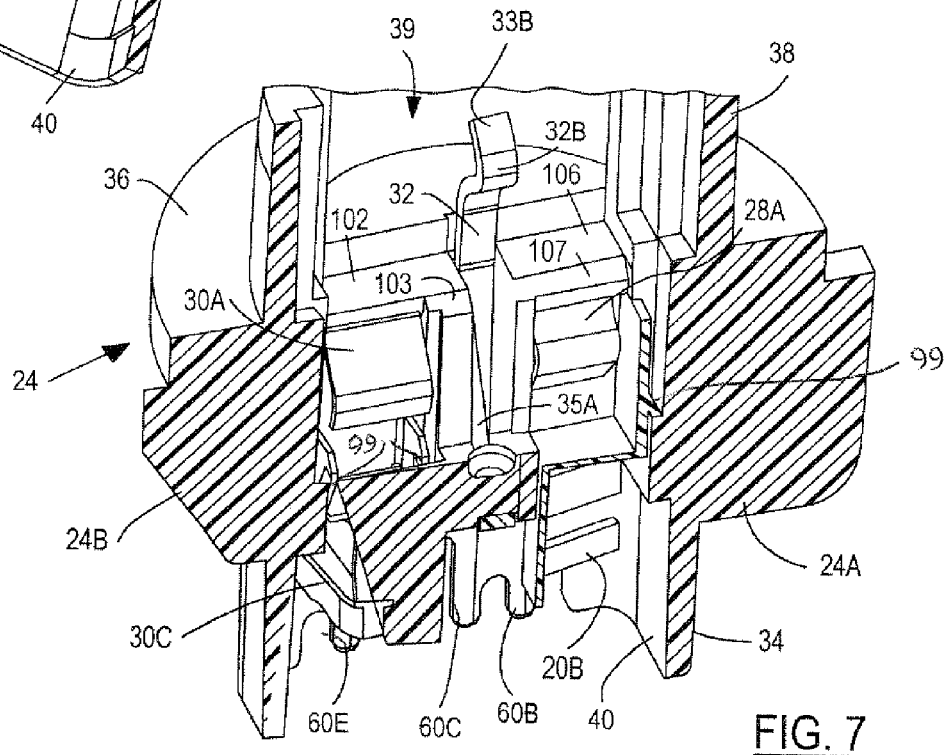
Figure 8:
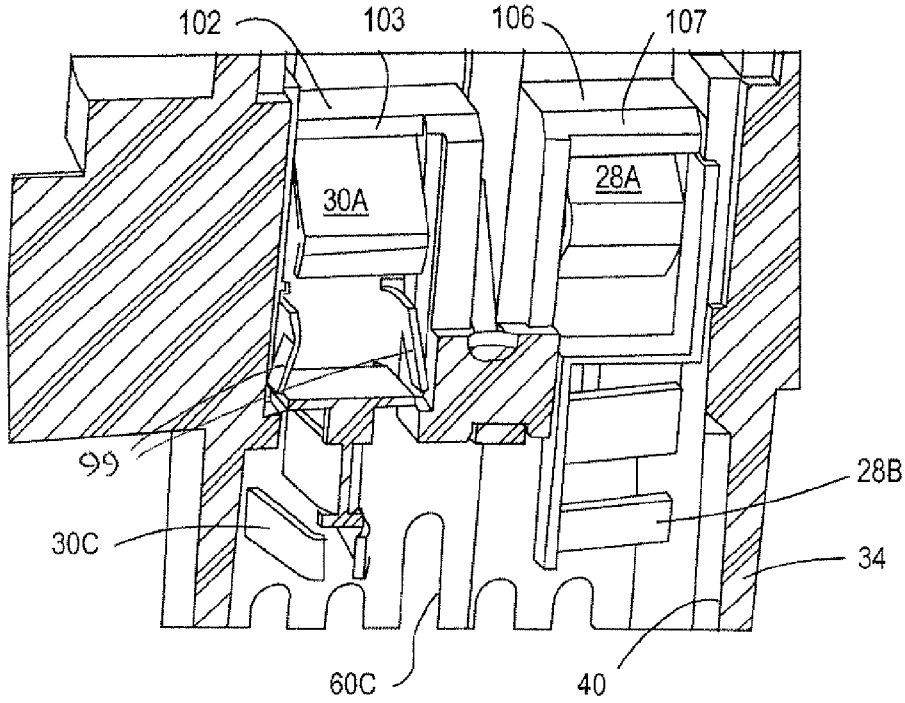

Each of the electrical terminal members includes one or more spring tab members, which are preferably positioned on the blades of the terminals. The tab members retain the terminal members in the lamp socket body 24 to prevent unintentional dislodging or removal thereof until the potting compound 42 is added which permanently secures the terminals in position. These tab members are shown in FIGS. 7 and 8 and identified by the reference numeral 99.

Figure 9:
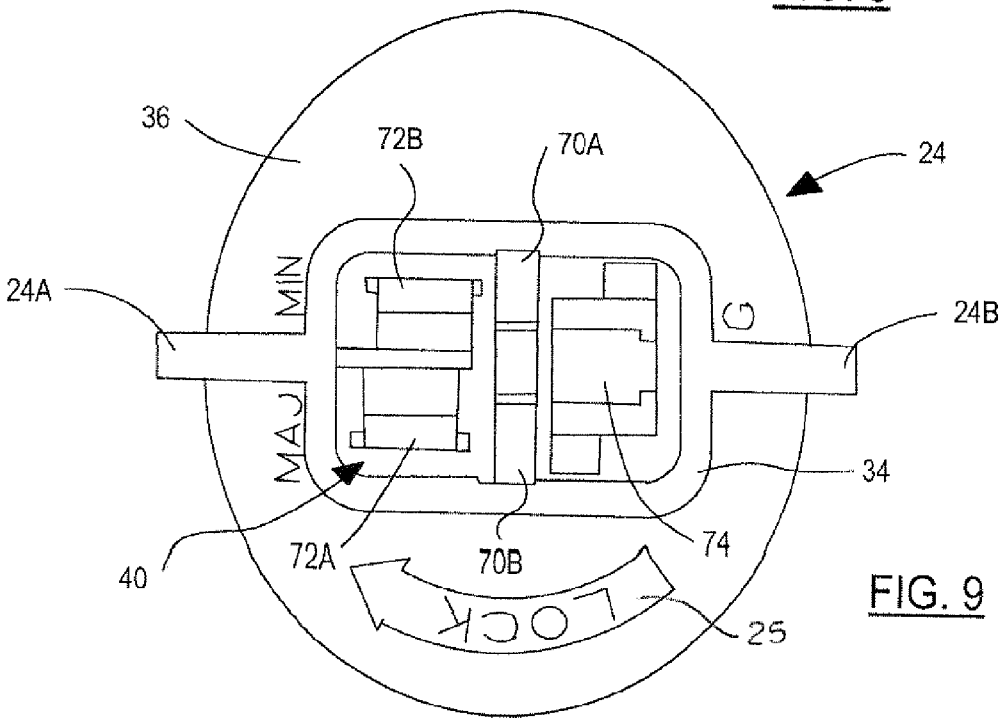
FIG. 9 is another elevational view of a lamp socket body member in accordance with the present invention.

The openings and channels for the electrical terminals and the spring clip member in the socket body member 24, are shown in FIG. 9. The spring clip member is inserted through openings 70A and 70B, the major and minor terminals are inserted through channels 72A and 72B, and the ground terminal 32 is inserted through opening 74.

Figure 3:
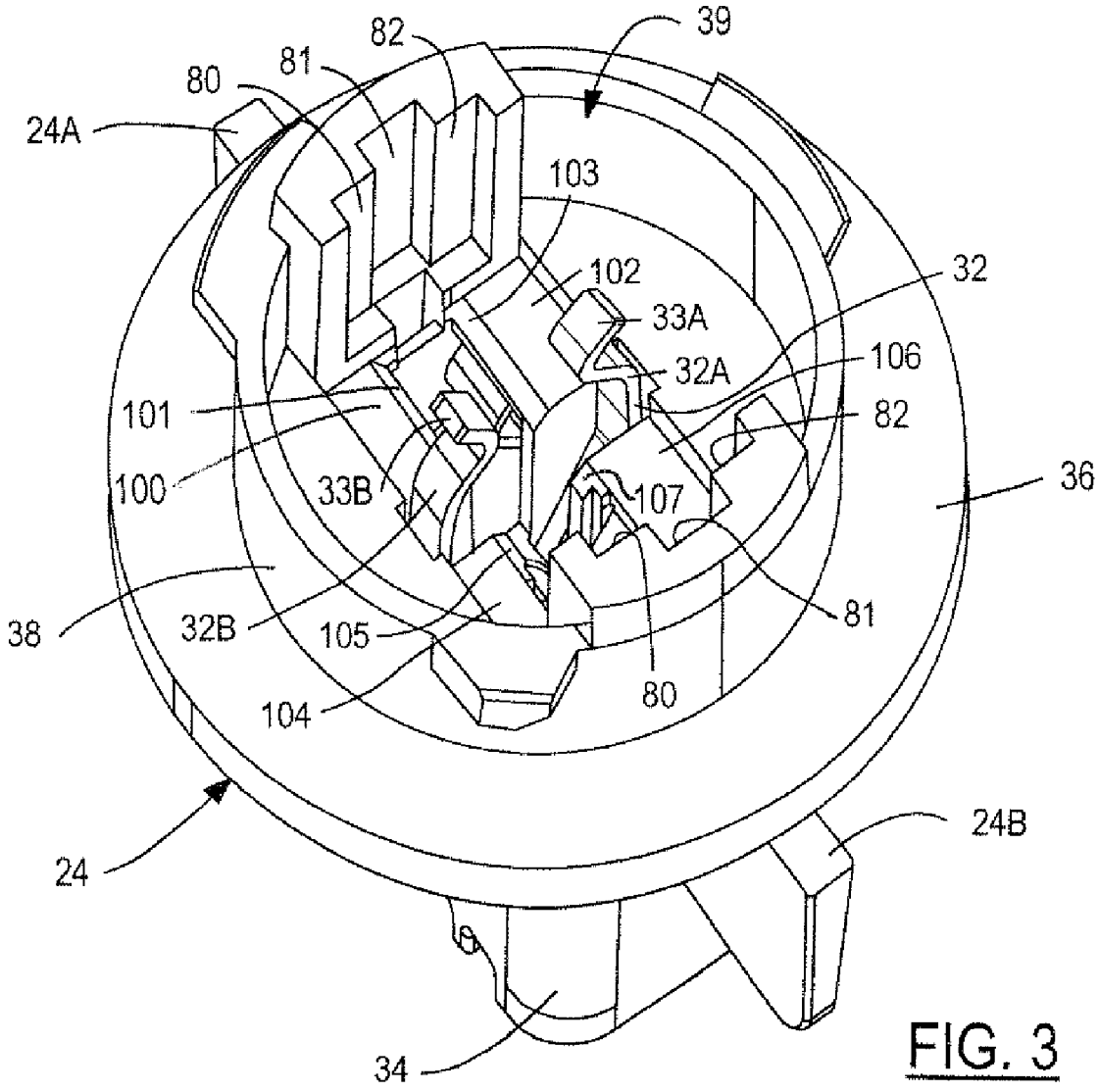
FIG. 3 is a perspective view of a lamp socket assembly in accordance with the present invention, the lamp socket being shown in the direction of the bulb insertion end.
Figure 4:
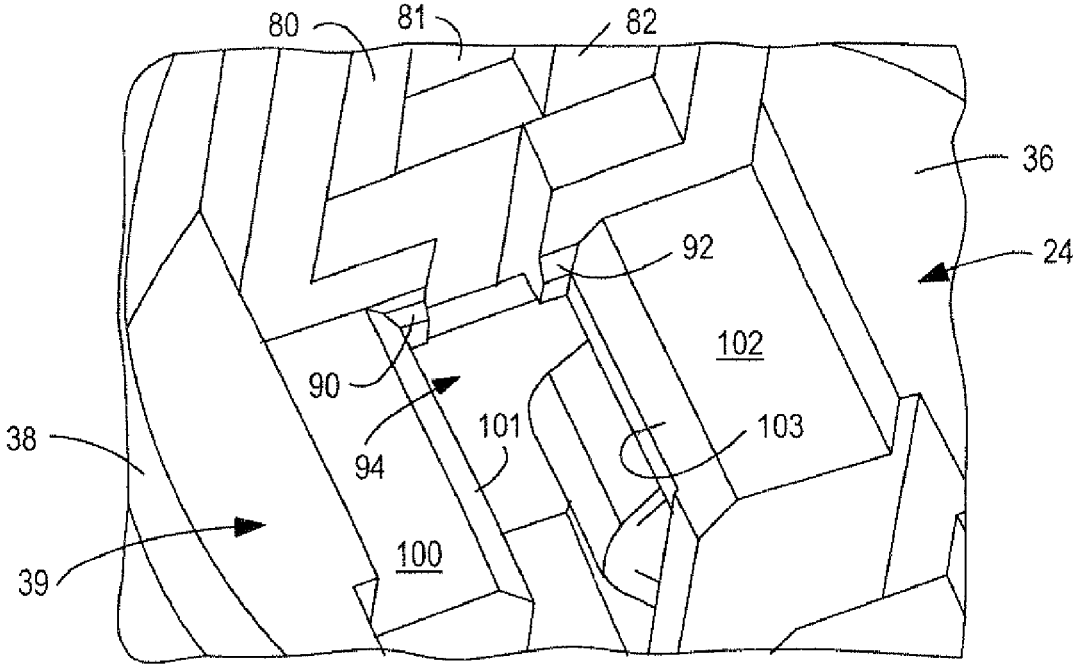
FIG. 4 is an enlarged view of a portion of the bulb insertion channel in a lamp socket body in accordance with the present invention.
Figure 5:
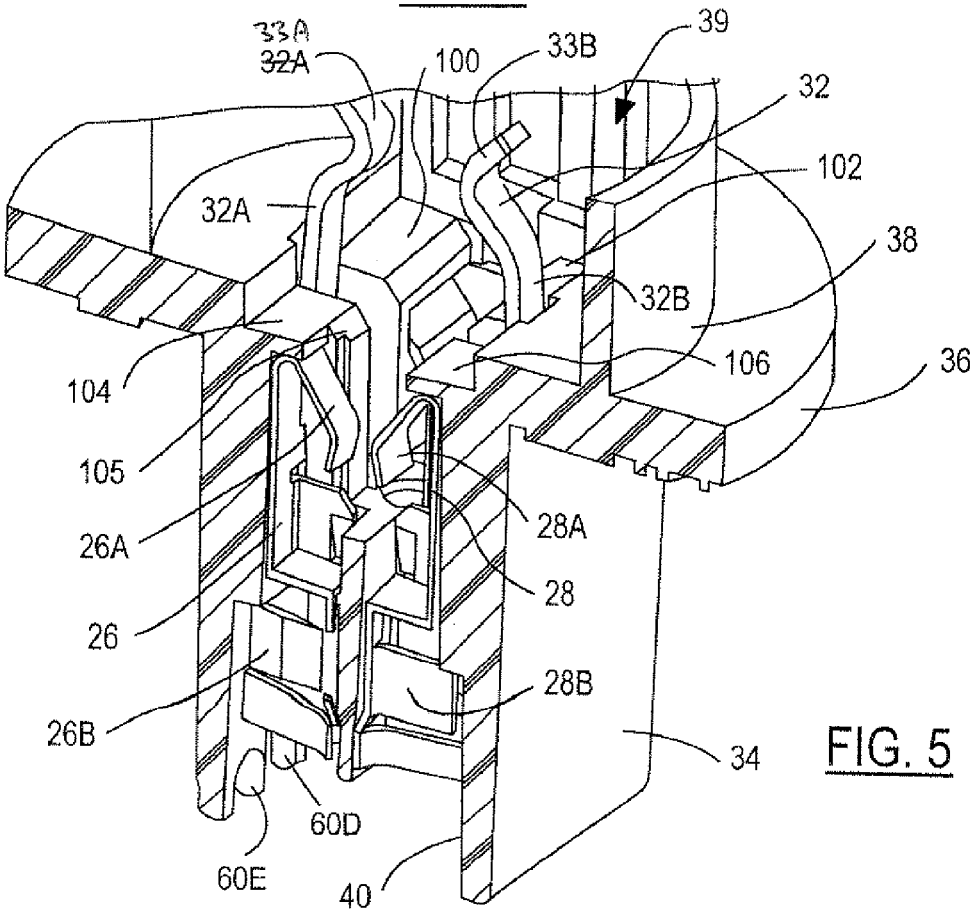
FIG. 5 is a cross-section of the lamp socket body member in accordance with the present invention.

As shown particularly in FIGS. 3 and 4, the base member 22B of the lamp bulb 22 is guided into the lamp receiving portion 38 of the lamp socket body 24 by a plurality of channel members 80, 81, and 82. In order to efficiently guide the base members 22B into the lamp socket body, a pair of ramp members 90 and 92 are positioned on each of the end corners of the central slot or opening 94 in which the distal end of the base member 22B is positioned. The ramp members 90 and 92 have inclined surfaces which ease and guide the entry of the lamp bulb into the lamp socket body member and prevent the lamp bulbs from hanging up or not being inserted in the appropriate manner into the lamp socket body.

Flange members (a/k/a "shroud members") 100 and 102 are also provided in the lamp socket body 24. The shroud members prevent the ends 30A and 30B of the ground terminal 30 from being crushed or damaged by the insertion of the bulb into the slot opening 94. The shroud members also have inclined surfaces 101 and 103, respectively, which also aid in the proper insertion of the lamp bulbs into the lamp socket body.

Corresponding shroud or flange members 104 and 106 are also provided to protect the blade ends 26A and 28A of the major and minor electrical terminals. These are shown in particular in FIGS. 3 and 5. The shroud members 104 and 106 also have inclined surfaces 105 and 107 which, similar to inclined surfaces 101 and 103, aid in the insertion of the wedge-type lamp bulbs into the lamp socket body members.

With the present design, the lamp socket body is optimized in order to insure minimum bulb wobble. The invention also provides terminal protection during insertion of the bulbs. Further, the present invention provides ramp members for eliminating or minimizing any possible hang up of the bulbs during insertion.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

What is claimed is:

1. A lamp socket assembly comprising:

a lamp socket body member having a bulb insertion portion, a lead connection portion and a central flange member;

at least one terminal member positioned in said lamp socket body member, said terminal member having a lead support portion positioned in said lead connection portion and at least one blade member positioned in said bulb insertion portion;

a spring clip member exhibiting a generally U-shaped body and which is engageable within a cavity established in said lamp socket body, said spring clip member including a pair of arms which terminate in outwardly directed and spring-type end members for holding a base member associated with the lamp bulb in place in said lamp socket body;

first and second pairs of ramp members positioned at each of end corners associated with a central opening defined in said lamp socket body and through which is communicated the lamp bulb base member;

said ramp members each exhibiting inclined surfaces such that misalignment of lamp bulbs during insertion into said lamp socket body member are minimized.

2. The lamp socket assembly as described in claim 1 wherein said lead support portion and blade member of said terminal member are in axial alignment.

3. The lamp socket assembly as described in claim 1 wherein the lead support portions of each terminal member are in axial alignment with its blade member.

4. The lamp socket assembly as described in claim 1 further comprising a shroud member adjacent said blade member for preventing a lamp bulb from damaging said blade member upon insertion into said lamp socket body member.

5. A lamp socket assembly comprising:

a lamp socket body member having a bulb insertion portion, a lead connection portion and a central flange member;

at least one terminal member positioned in said lamp socket body member, said terminal member having a lead support portion positioned in said lead connection portion and a blade member positioned in said bulb insertion portion;

at least one shroud member incorporated in said lamp socket body member at locations surrounding a central opening defined in said lamp socket body and through which is communicated a lamp bulb base member, each of said shroud members terminating in an inclined surface and positioned overlaying associated blade members in order to protect said blade member during insertion of a lamp bulb into said lamp socket body member and while aiding in the insertion of said lamp bulb into said lamp socket body.

6. The lamp socket assembly of claim 5 wherein a plurality of terminal members with blade members and corresponding protective shroud members are provided in said lamp socket body member.

7. The lamp socket assembly of claim 5 wherein the terminal member is an axial terminal.

8. The lamp socket assembly of claim 5 wherein the terminal member is a box terminal having two opposite blade members, at least one of said blade members having a tab member for assisting in securing said terminal member in said lamp socket body.

9. The lamp socket assembly as described in claim 5 further comprising a metal spring clip for holding a lamp bulb in said lamp socket body member.

10. The lamp socket assembly as described in claim 5 further comprising a plurality of ramp members positioned at each of end corners associated with said central opening defined in said lamp socket body member for facilitating insertion of a lamp bulb into said lamp socket body member.

* * * * *